United States Patent [19]

Pike

[11] Patent Number: 4,459,650

[45] Date of Patent: Jul. 10, 1984

[54] WALL MOUNTED LAMP SWIVEL ARM ASSEMBLY

[75] Inventor: Louis D. Pike, Moreland Hills, Ohio

[73] Assignee: Pipe Machine Products Company, Cleveland, Ohio

[21] Appl. No.: 456,092

[22] Filed: Jan. 6, 1983

[51] Int. Cl.[3] ..... F21M 3/18

[52] U.S. Cl. ..... 362/427; 362/285; 362/430; 362/432

[58] Field of Search ..... 362/427, 432, 285, 430

[56] References Cited

U.S. PATENT DOCUMENTS

| | | | |
|---|---|---|---|
| 2,280,402 | 4/1942 | Greppin | 362/432 X |
| 2,488,898 | 11/1949 | Brasty | 248/282 |
| 2,582,159 | 1/1952 | Race | 250/33 |
| 2,950,892 | 8/1960 | Rick | 362/432 X |
| 3,322,886 | 5/1967 | Warshawsky | 174/86 |
| 3,576,988 | 5/1971 | Henning | 362/427 |
| 3,983,386 | 9/1976 | Schallenkammer | 362/427 |
| 4,247,886 | 1/1981 | Warshawsky | 362/427 |
| 4,319,314 | 3/1982 | Morton | 362/432 |

OTHER PUBLICATIONS

Pike Machine Products Co. Catalog.

I. W. Industries, Inc., Catalog No. 1883, pp. 52–53, 72–80.

*Primary Examiner*—Stephen J. Lechert, Jr.

*Attorney, Agent, or Firm*—Fay & Sharpe

[57] ABSTRACT

A swivel assembly (A) connects a lamp arm assembly (B) with a wall mounting (C). A lamp assembly (D) is supported by the lamp arm assembly. The swivel assembly includes a first swivel member (10), a second swivel member (20), and a third swivel member (30) each having an axial passage therethrough. A first end (42) of a first arm (40) is nonrotatably connected axially with the second swivel member. A linear region (46) of the first arm extends rotatably through the axial passage of the third swivel member. The first and third swivel members are connected with the wall mounting by threaded sleeves (96, 102). In this manner, the second swivel member and the attached arm which extends axially therefrom are able to be rotated selectively around the wall mounting.

18 Claims, 3 Drawing Figures

WALL MOUNTED LAMP SWIVEL ARM ASSEMBLY

BACKGROUND OF THE INVENTION

The present invention relates to swivel and pivot arrangements. The present invention finds particular application in mounting a lamp arm rotatably to a vertical surface and will be described with reference thereto. However, it is to be appreciated that the present invention may find application in mounting arms to horizontal and other nonvertical surfaces and may find utility in conjunction with arms or elongated members for supporting other electrical and nonelectrical structures such as candle sconces, microphones, and the like.

Commonly, a wall mounted lamp includes a wall mounting such as a decorative box or plate which is adapted to be hung or fastened to a wall. A double male or double-M swivel which has three aligned swivel members is connected to the wall mounting. In the double male swivel, the center member has an axial passage extending therethrough and male connection annular sleeves extending axially outward. Two end members each have an axial passage with a female connection restriction or inward projecting collar adjacent the center member. The male connection sleeves are rotatably received in the end member axial passages through the female connection restrictions. The male connection sleeves are flared over the female connection restrictions. The pressure with which the male connection sleeves are pressed against the female connection restrictions determines the amount of drag or frictional resistance required to rotate the central member relative to the end members. The two end swivel members of the double male swivel are connected nonrotatably with the wall mounting with hollow threaded connectors. The center swivel member is rotatably mounted between the two end swivel members for rotation about a central axis. A lamp arm is connected with the center swivel member transverse to the central axis for selective rotation around the wall mounting. Optionally, the lamp arm may include an additional swivel connection therein to facilitate positioning the lamp in a greater range of orientations and positions. An electrical wire passes from the wall mounting through one of the threaded connectors into the axial passage of one of the end members. The wire further passes through the flared, male-female connection between the end member and the center member, along the central member axial passage, and through the lamp arm.

Although the double-M swivel has been fairly successful, there are drawbacks associated with it. One drawback is that it places restraints on styling of the lamp arm. Particularly, heretofore, lamp arms have extended substantially radially from the center swivel member. No provision was made for extending a lamp arm axially from the central swivel member.

SUMMARY OF THE INVENTION

In accordance with the present invention, there is provided a swivel assembly from which a pivoted arm extends axially.

In accordance with a more limited aspect of the invention, there is provided a swivel arm assembly for mounting a lamp or the like to a wall or other surface. A first swivel member has a first axial passage therein. A tubular connector connects the first swivel member to a wall mounting and provides a wire receiving passage between the wall mounting and the first axial passage. A second swivel member having a second axial passage therethrough is connected with the first swivel member with a male-female connection. The male-female connection maintains the first and second swivel members in axial alignment while permitting rotational movement therebetween. A first arm has a first end axially received in the second axial passage and a second end which is adapted for supporting a lamp or the like. The arm defines a wire receiving channel therethrough which is operatively connected with the second axial passage. In this manner, a continuous wire is adapted to pass from the wall mounting, through the tubular connector, through the first axial passage, and through the wire receiving channel. A third swivel member has a third axial passage therethrough in which the arm is rotatably received adjacent its first end. The third swivel member is disposed closely adjacent the second swivel member in axial alignment therewith. A bearing surface is provided between the second and third swivel members such that the third swivel member supports the second swivel while permitting relative rotational movement therebetween. A connecting means connects the third swivel member with the wall mounting. In this manner, the first and third swivel members remain stationary and rotatably support the second swivel member allowing the arm means to be selectively rotated relative to the wall mounting.

One advantage of the present invention is that the arm extends axially from the swivel assembly in either an upward or downward direction.

Another advantage of the present invention is that a relatively weak swivel assembly is supported in such a manner to substantially increase its strength.

Another advantage of the present invention is that it provides vertical axis stability, preventing rotation on the wall.

Still further advantages of the present invention will become apparent to those of ordinary skill in the art upon reading and understanding the following detailed description of the preferred embodiments.

BRIEF DESCRIPTION OF THE DRAWINGS

The invention may take form in various parts and arrangements of parts. The drawings are only for purposes of illustrating preferred embodiments of the invention and are not to be construed as limiting it.

DETAILED DESCRIPTION OF THE PREFERRED EMBODIMENTS

Figure 1:
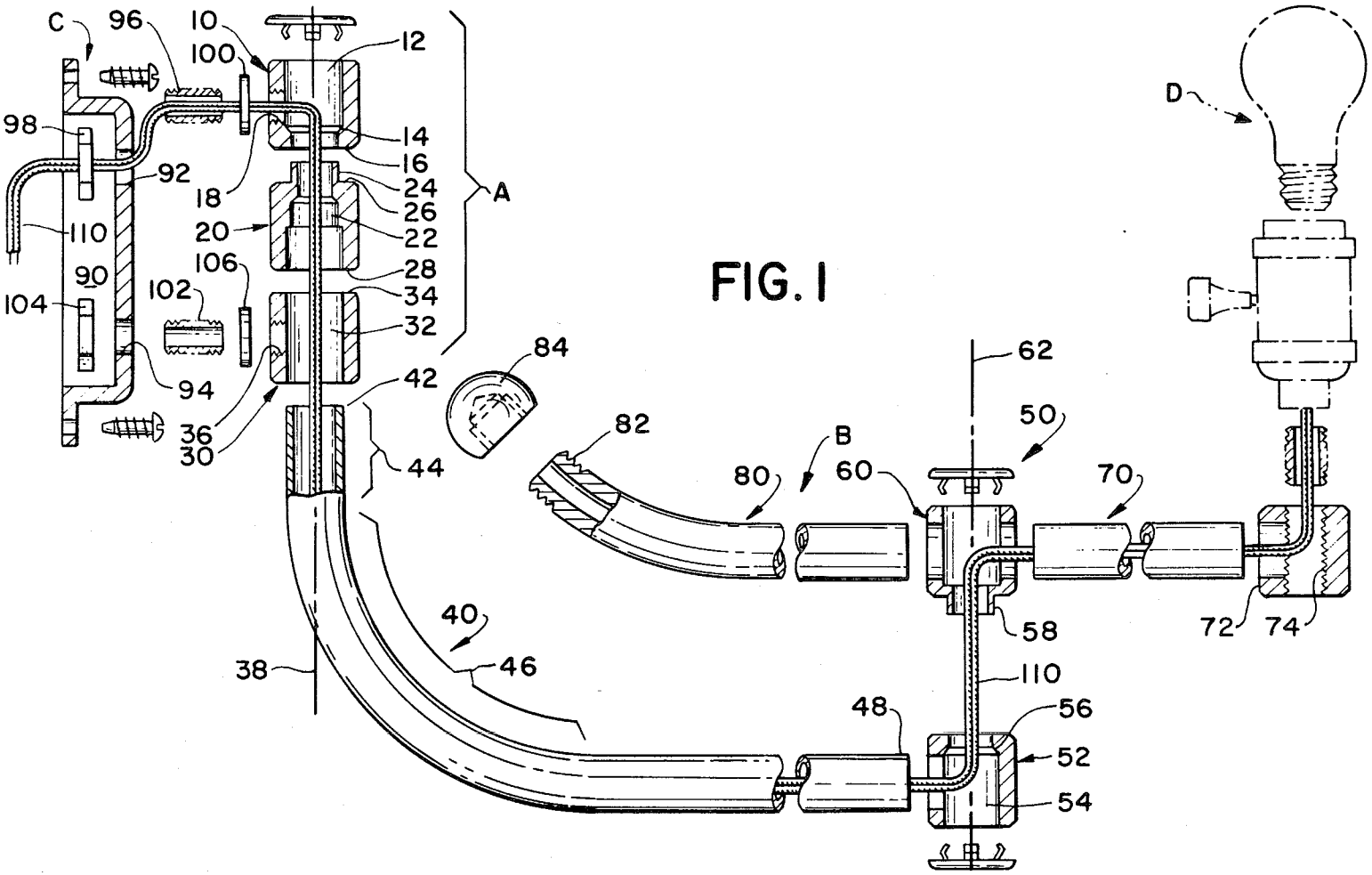
FIG. 1 is an exploded view in partial section of a wall mountable swivel arm assembly.
Figure 2:
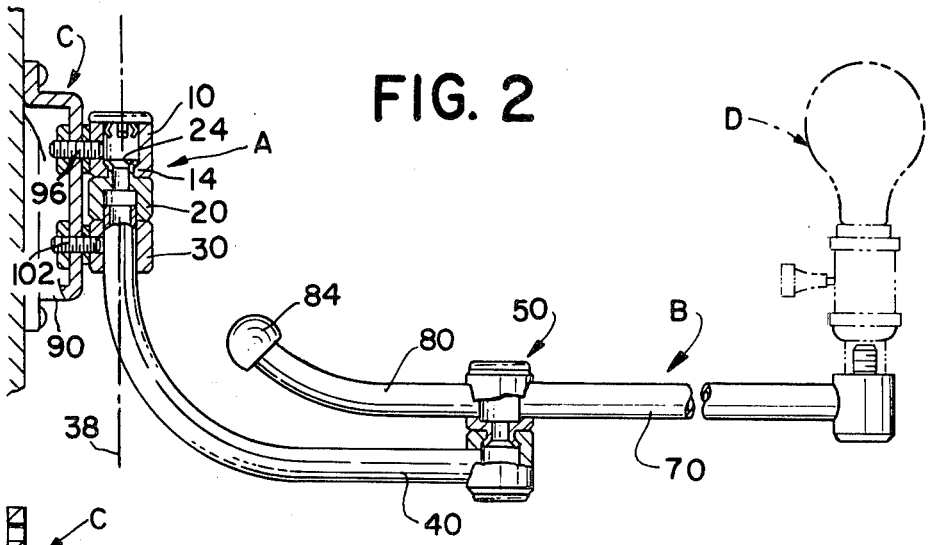
FIG. 2 is an assembled view in partial section of the swivel arm assembly of FIG. 1 with the electrical wire omitted for simplicity of illustration; and, FIG. 3 is an alternate embodiment of a swivel arm assembly in accordance with the present invention.

With particular reference to FIGS. 1 and 2, a swivel assembly A connects a lamp arm assembly B with a wall mounting C. A lamp assembly D is supported by the lamp arm assembly B. When the wall mounting C is connected with a wall, the swivel assembly A enables the lamp assembly D to be positioned selectively among a plurality of positions.

With continuing reference to FIGS. 1 and 2, the swivel assembly A includes a first or upper end swivel member 10 which defines a first axial passage 12 therein.

An inward projecting female connection restriction or collar 14 is disposed adjacent one end of the first axial passage. A first bearing surface 16 is defined on an end face of the first swivel member adjacent the annular restriction 14. A threaded bore 18 is disposed radially in communication with the first axial passage.

A second or center swivel member 20 defines a second axial passage 22 therethrough. An annular male connector sleeve 24 which extends from one end of the second swivel member is adapted to be rotatably received through the female connection restriction 14. The male connection sleeve is flared over the annular restriction and pressed thereagainst. The amount of pressure with which the male connection sleeve and the female connection restriction are press fit together determines the drag or resistance to rotation between the first and second swivel members. Thus, the press fit of the male connection sleeve and the female connection restriction functions as a drag selection means to select the amount of frictional drag or resistance to rotation of the swivel assembly. The second swivel member defines bearing surfaces 26 and 28 at opposite ends thereof.

A third swivel member 30 defines a third axial passage 32 therethrough. The third swivel member has a bearing surface 34 at one end thereof which is adapted to interact with second swivel member bearing surface 28 to enable the second and third swivel members to undergo relative rotational movement. A threaded bore 36 extends radially from the third swivel member. When assembled, the first, second, and third swivel members as well as the first, second, and third axially passages are aligned along a first central axis 38.

The lamp arm assembly B includes a first tubular lamp arm 40 which defines a wire receiving channel therethrough. The first arm has an arm first end 42 which is nonrotatably received axially in the second swivel member axial passage 22. In the preferred embodiment, the arm first end 42 is brazed to the second swivel member, although other interconnections, such as a threaded interconnection, may optionally be used. Adjacent the arm first end 42, the first arm has a linear region 44 which is rotatably received through the third swivel member axial passage 32. In this manner, the first arm 40 and the second swivel member 20 are rotatably received in the first and third swivel members 10 and 30. The first arm includes an arcuate or curved region 46 which is bent substantially 90 degrees. In this manner, the first arm is positioned with the linear region 44 extending substantially in alignment with the first central axis 38 and an arm second end 48 extending generally traverse to the first central axis.

A second or lamp arm assembly swivel means 50 is connected with the first arm second end 48. The arm assembly swivel means 50 includes a first or female swivel element 52 which is joined to the first arm second end 48. The first swivel element has an axial wire receiving bore 54 extending therethrough with a female connection restriction 56 therein. A male connector sleeve 58 of a second or male swivel element is flared around and pressed against the female connection restriction 56 to connect the male and female swivel elements together for rotation about a second central axis 62.

A second tubular arm 70 extends between the arm assembly swivel means 50 and a lamp assembly mounting means 72 having a threaded bore 74 therethrough. In the preferred embodiment, the second arm is thin wall tubing which is brazed to the second swivel element 60 and the lamp assembly mounting means 72.

A third arm 80 is connected with the second swivel element 60. The third arm is aligned with the second arm and curved to conform with the curvature of the first arm. The third arm portion 80 has a threaded section 82 at one end for receiving a finial such as a ball 84.

It is to be appreciated, that the lamp mounting assembly 72 may, optionally, be mounted directly on the first arm. Such a mounting arrangement allows the lamp assembly to be rotated along an arc of about 180°. The lamp arm swivel means 50 and the second arm portion 70 add a second degree of freedom to the movement of the lamp assembly. The second degree of freedom allows the lamp assembly to be moved not only along an arc but to be positioned at a continuum of positions inside a plane defined by the semicircular arc.

The wall mounting assembly C includes a decorative box 90 having a pair of swivel mounting apertures 92 and 94 extending therethrough. A first connecting means or tubular connector 96 connects the first swivel member 10 with the wall box 90. In the preferred embodiment, the tubular connector is an exteriorly threaded sleeve which is threadedly received in the first swivel member radial threaded bore 18 and extends through the first box aperture 92. A first nut 98 or other threaded fastener secures the tubular connector and with it the first swivel member to the wall box. Optionally, a washer or other spacing means 100 may be disposed around the tubular connector to space the swivel assembly A a small distance from the wall box 90 to assure that the second swivel member and the wall box do not engage.

A second connecting means 102, such as a second threaded sleeve, connects the third swivel member 30 with the wall box 90. The second threaded sleeve 102 is threadedly received in the third swivel member radial threaded bore 36 and is fastened through the wall box second aperture 94 by a nut or other threaded connecting means 104. Optionally, a washer or other spacing means 106 may be disposed around the second exteriorly threaded sleeve 102 to space the third swivel member, hence the swivel assembly, from the wall box.

A continuous length of lamp wire 110 is connected at one end directly with home wiring or with a wall plug for indirect connection with home wiring. The lamp wire extends through the first nut 98, the wall box first aperture 92, the tubular connector 96 into the first swivel member axial passage 12. The lamp wire extends through the male-female connection between the first and second swivel members into the second swivel member axial passage. The lamp wire further extends through the lamp receiving channel of the first arm 40, the arm assembly swivel means 50, the second arm 70, and the lamp mounting structure 72. In this manner, a continuous length of wire extends from the wall box through the swivel arm assembly to the lamp assembly. The wire is inhibited from becoming twisted and damaged by the geometry of the arm assembly. The first arm is limited by the wall to about 180° of rotation. In the preferred embodiment, the second arm portion is longer than the distance between the first and second central axes such that the wall and swivel assembly limit the second arm to less than 360° of rotation about the arm assembly swivel means 50. In this manner, the lamp wire cannot be twisted tighter and tighter until it fractures or otherwise fails.

Figure 3:
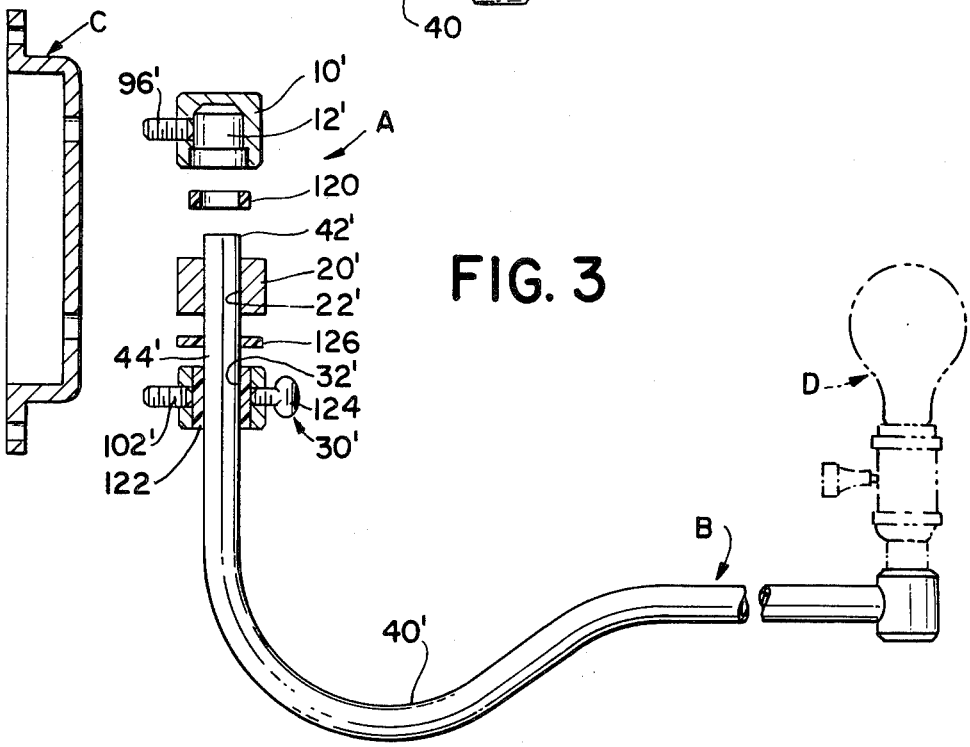

In the embodiment of FIG. 3, like elements with elements of the embodiments of FIGS. 1 and 2 are denoted with the same reference numeral but followed by a prime (′). The swivel assembly A includes a first swivel member 10′ having an axial passage 12′ therein. A second swivel member 20′ has an axial passage 22′ which is adapted to be disposed in axial alignment with the first axial passage. A third swivel member 30′ defines a third axial passage 32′.

The arm assembly B includes a first arm 40′ having an arm first end 42′. The first arm is fixedly received in the second swivel portion 20′ by brazing or other like method of interconnection with the arm first end 42′ extending axially therefrom toward the first swivel member 10′. The first swivel member axials bore 12′ and the arm first end 42′ function as a male-female connection means for connecting the first and second swivel members in a rotatable relationship. Optionally, a polymeric sleeve or brushing 120 may be disposed around the arm portion first end to provide a bearing surface between the first and second swivel members.

In the embodiment of FIGS. 1 and 2, the pressure with which the male connecting sleeve was press fit against the female connection portion functioned as the means for selecting the drag of the swivel. In the embodiment of FIG. 3, the drag selecting means includes a polymeric sleeve 122 which is disposed between the third swivel member 30′ and the first arm linear region 44′. A drag adjusting means 124 selectively adjusts the degree of frictional engagement between the polymeric sleeve and the first arm linear region such that the drag is selectively adjustable. Optionally, a second polymeric washer or bushing 126 may be disposed between the second and third swivel members to provide a smooth bearing surface therebetween.

A tubular connector 96′ connects the first swivel member with the wall mounting C and provides a wire receiving path between the wall mounting and the first axial passage 12′. A second connecting means 102′ connects the third swivel member with the wall mounting C. In the preferred embodiment, the second connecting means 102′ is a threaded member which is threadedly received radially in the third swivel member. Optionally, the threaded member may be selectively cammed against the polymeric drag adjusting sleeve 122 to adjust the frictional drag of the swivel.

As other options, it is to be appreciated that the swivel assembly A may be mounted on the wall mounting C with the opposite orientation such that the arm assembly B extends from the top of the swivel assembly. As yet another alternative, the arm assembly may include an arm portion extending radially from the second swivel member parallel to the first arm. The lamp arm swivel assembly may be a three member swivel which connects the parallel arm portions with the second arm. Further, other known swivel assembly constructions may be utilized to interconnect the first and second swivel members and the first and second swivel.

The invention has been described with reference to the preferred embodiment. Obviously, modifications and alterations will occur to others upon reading and understanding the preceding specification. It is intended that the invention be construed as including all such alterations and modifications insofar as they come within the scope of the appended claims or the equivalents thereof.

Having described preferred embodiments, the invention is now claimed to be:

1. A swivel arm assembly for supporting lighting fixtures and the like, the swivel arm assembly comprising:

a first swivel member including a first axial passage therein;

a first connecting means for connecting the first swivel member to a wall mounting;

a second swivel member including a second axial passage therethrough, the first and second swivel members being operatively connected with a male-female connection which maintains axial alignment while permitting rotational movement therebetween;

a first arm including a first arm end axially received in the second axial passage;

a third swivel member including a third axial passage therethrough, the first arm being rotatably received adjacent the arm first end in the third axial passage, the third swivel member being disposed closely adjacent the second swivel member in an axial aligned, rotational relationship therewith; and, second connecting means for connecting the third swivel member with the wall mounting, whereby the first and third swivel members rotatably support the second swivel member allowing the first arm to be rotated selectively relative to the wall mounting.

2. The swivel arm assembly as set forth in claim 1 wherein the first connecting means includes a tubular connector which provides a wire receiving passage between the wall mounting and the first axial passage and wherein the first arm defines a wire receiving channel therethrough, the wire receiving channel being operatively connected with the second axial passage, whereby a continuous wire is adapted to pass from the wall mounting, through the tubular connector, through the first axial passage, and through the wire receiving channel.

3. The swivel arm assembly as set forth in claim 2 wherein the male-female connection includes an annular female connection restriction projecting inward into the first axial passage and an axially extending male connection sleeve extending rotatably through the female connection restriction, the male connection sleeve being flared around the female connection restriction to inhibit axial uncoupling movement between the first and second swivel members.

4. The swivel arm assembly as set forth in claim 2 wherein the second and the third swivel members include abutting bearing surfaces in intimate, rotationally sliding contact with each other.

5. The swivel arm assembly as set forth in claim 2 further including a bushing member disposed between the second and third swivel members to provide at least one bearing surface therebetween such that the third swivel member supports the second swivel member.

6. The swivel arm assembly as set forth in claim 2 further including drag means for providing a selected drag between the second swivel member and at least one of the first and third swivel members.

7. The swivel arm assembly as set forth in claim 2 wherein the first arm assembly includes an arcuate portion in which the first arm is bent generally 90°, whereby a lamp assembly or the like mounted on the first arm is adapted to be rotated at least through a circular arc segment around a central axis of the first, second, and third swivel members.

8. The swivel arm assembly as set forth in claim 2 further including a lighting fixture operatively connected with the first arm.

9. The swivel arm assembly as set forth in claim 2 further including a second arm operatively connected with the first arm by an arm assembly swivel means such that the first and second arms are adapted to undergo relative rotational movement.

10. The swivel arm assembly as set forth in claim 9 wherein the arm assembly swivel means includes a first swivel element operatively connected with the first arm and a second swivel element operatively connected with the second arm, and further including a third arm operatively connected with the second swivel element in axial alignment with the second arm.

11. The swivel arm assembly as set forth in claim 10 wherein the first arm includes an arcuate region between the arm first end and the arm assembly swivel means, whereby when the wall mounting is mounted to a wall, the second arm extends outward from the wall.

12. The swivel arm assembly as set forth in claim 11 wherein the first, second, and third swivel members rotate about a first central axis and the first and second swivel elements rotate about a second central axis and wherein the first and second central axes are substantially parallel.

13. A wall mountable lamp arm assembly comprising:

a first swivel member including a first axial passage therein and a threaded radially extending bore intersecting the first axial passage;

a first tubular connector threadedly received in the first radial passage for connecting the first swivel member with a wall mounting, the tubular connector defining a wire receiving passage therethrough between the wall mounting and the first axial passage;

a second swivel member including a second axial passage therethrough in axial alignment with the first axial passage, the first and second swivel members being operatively connected with a male-female connection which maintains the first and second swivel members in axial alignment about a first central axis while permitting rotational movement around the first central axis;

a first arm including an arm first end axially and non-rotatably received in the second axial passage, the first arm defining a wire receiving channel therethrough in communication with the first passage;

a third swivel member having a third axial passage therethrough in alignment with the first and second axial passages, the first arm being rotatably received adjacent the arm first end in the third axial passage, the third swivel member being disposed adjacent the second swivel member in an axially aligned, rotatable relationship therewith;

connecting means for connecting the third swivel member with the wall mounting; and a continuous length of wire extending from the wall mounting, through the tubular connector, through the first axial passage, and through the arm wire receiving channel.

14. The lamp arm assembly as set forth in claim 13 wherein the first arm includes a linear region adjacent the lamp arm first end disposed in axial alignment with the first central axis and wherein the first arm includes an arm second end extending substantially transverse to the first central axis.

15. The lamp arm assembly as set forth in claim 14 further including an arm assembly swivel means operatively connected with the arm second end and a second arm extending from the arm swivel means.

16. The lamp arm assembly as set forth in claim 15 wherein the arm swivel means includes a first swivel element connected with the first arm and a second swivel element connected with the second arm, the first and second swivel elements being disposed for relative rotation about a second central axis which is parallel to the first central axis.

17. The lamp arm assembly as set forth in claim 13 further including drag selection means for selecting a drag between the second swivel member and at least one of the first and third swivel members for selecting the drag to be overcome in rotating the first arm relative to the wall mounting.

18. The lamp arm assembly as set forth in claim 17 wherein the drag selection means includes a male connection sleeve extending from the second swivel member and the female connection restriction extending into the first axial passage, the male connection sleeve being flared over and pressed against the female connection restriction, the drag being selected by the pressure with which the male connection sleeve is pressed against the female connection restriction.

* * * * *